US009107799B2

(12) United States Patent
Muchisky

(10) Patent No.: US 9,107,799 B2
(45) Date of Patent: Aug. 18, 2015

(54) SELF CONTAINED MASSAGE HEAD AND METHOD OF APPLYING MASSAGE FORCES

(76) Inventor: Thomas Muchisky, St. Louis County, MO (US)

( * ) Notice: Subject to any disclaimer, the term of this patent is extended or adjusted under 35 U.S.C. 154(b) by 982 days.

(21) Appl. No.: 12/682,342

(22) PCT Filed: Oct. 10, 2008

(86) PCT No.: PCT/US2008/079548

§ 371 (c)(1),
(2), (4) Date: May 11, 2010

(87) PCT Pub. No.: WO2009/049185

PCT Pub. Date: Apr. 16, 2009

(65) Prior Publication Data

US 2010/0217165 A1 Aug. 26, 2010

Related U.S. Application Data

(60) Provisional application No. 60/978,914, filed on Oct. 10, 2007.

(51) Int. Cl.

| | |
|---|---|
| ***A61H 23/00*** | (2006.01) |
| ***A61H 23/02*** | (2006.01) |
| ***A61H 7/00*** | (2006.01) |

(52) U.S. Cl.

CPC ..... *A61H 23/0263* (2013.01); *A61H 7/005* (2013.01)

(58) Field of Classification Search

CPC ..... A61H 1/00; A61H 7/00; A61H 23/00; A61H 37/00; A61H 23/0263; A61H 23/0254; A61H 2201/0165; A61H 2201/1418; A61H 2201/1669; A61H 2201/1678; A61H 2201/0153; A61H 2201/1685

USPC ..... 601/46, 49, 53, 54, 56, 57, 58, 61, 66, 601/67, 69, 70, 72, 73, 74, 78, 81, 84, 89, 601/90, 92, 93, 95, 107, 108, 11, 134, 135, 601/136, 137

See application file for complete search history.

(56) References Cited

U.S. PATENT DOCUMENTS

| | | | |
|---|---|---|---|
| 4,098,266 | A | 7/1978 | Muchisky et al. |
| 4,102,334 | A | 7/1978 | Muchisky |

(Continued)

OTHER PUBLICATIONS

PCT Notification of transmittal of the International Search Report and the Written Opinion of the International Searching Authority, or the Declaration, for the International Application No. PCT/US08/79548, International filling date Oct. 10, 2008.

*Primary Examiner* — Quang D Thanh

(74) *Attorney, Agent, or Firm* — Polster, Lieder, Woodruff & Lucchesi, L.C.

(57) ABSTRACT

A massage apparatus for use in the therapeutic application of repetitive vibratory force to a recipient. The massage apparatus 5 comprises a housing 10 having a hand portion 26 and a cuff portion 42. The apparatus 5 also comprises a pancake motor mounted 50 within the hand portion 26, the pancake motor 50 having a drive shaft 60 extending forward along the direction of a longitudinal axis 24 of the housing 10. An oscillating assembly 72 mounts within the cuff portion 42 and attaches to the drive shaft 60 of the pancake motor 50, wherein the oscillating assembly 72 translates rotary motion of the drive shaft 60 into orbital oscillations. A counterweight 108 operatively connects to the pancake motor 50 wherein the counterweight 108 decreases vibration in the hand portion 26 by compensating forces generated by the oscillating assembly 72.

19 Claims, 9 Drawing Sheets

(56) References Cited

U.S. PATENT DOCUMENTS 4,919,117 A 4/1990 Muchisky et al.
6,013,040 A * 1/2000 Morgenstern et al. ..... 601/103
6,478,755 B2 11/2002 Young
2005/0159685 A1 7/2005 Klein et al.

* cited by examiner

SELF CONTAINED MASSAGE HEAD AND METHOD OF APPLYING MASSAGE FORCES

CROSS-REFERENCE TO RELATED APPLICATIONS

This application is the United States National Stage under 35 U.S.C. §371 of International Application Serial No. PCT/US2008/079548 having an International Filing Date of Oct. 10, 2008, and is related to and claims priority to U.S. Provisional Patent Application No. 60/978,914, filed Oct. 10, 2007, the contents of both of which are incorporated herein by reference.

STATEMENT REGARDING FEDERALLY SPONSORED RESEARCH

Not Applicable.

TECHNICAL FIELD

This disclosure relates to massage devices in which therapeutic benefits are achieved through the application of vibratory force to a recipient's body. More particularly, the present disclosure relates to a massage apparatus which is self contained in a hand operated application head, which offers the advantages of physically more complicated devices, and may be used for both medical and massage therapies.

Early gyratory massage head design dates back to the 1950's, to an apparatus developed by Henri Cuinier and described in French Patent No. 1,171,727. Since that time, there have been few innovations in the massage machines, themselves, or what has become known in the art as the massage head used to accommodate a particular applicator design. There have been as many as twenty massage machine manufacturers in the world market since then, including France, the United States and China, but all have produced massage heads substantially similar designs, even going so far as to use identical thread designs to secure various applicators to the massage heads. In general, these devices have used a drive motor located some distance, conventionally three to five feet or more away from each massage head connected by a heavy but flexible drive cable encased in an even heavier sheath to power the massage head. The massage heads themselves of these devices employed a hard, cylindrical plastic handle affixed perpendicularly to the face of the massage head as a means of holding and controlling the massage head. In addition, since the motor was located some distance from the massage head, the motor speed controls also were mounted at the location of the motor.

Attempts have been made to reduce the size of massage heads and eliminate the size of massage devices. For example, U.S. Pat. No. 6,478,755 (the "'755 patent"), incorporated herein by reference, discloses a portable personal massager in which the motor driving the gyratory massage head is located in the massage head assembly resulting in a vertical, handle held head. During operation, the operator holds the device in place against the recipient's body. Due to the space restrictions inside the tubular handle of this portable massager, however, this massager applies a low amount of deliverable massage power to the body. While the device described in the '755 patent works for its intended personal or home use purpose, the massage and therapeutic benefits obtained with this device were not the equivalent of those obtained by the professional or commercial embodiments, shown for example in U.S. Pat. No. 4,102,334. These devices all transmit a significant amount of the vibratory energy produced to the hands of the user through the housing. Long term exposure to these vibrations on the part of a user, operator or attendant using these massagers on a regular basis can result in repetitive motion type injury, including the development of Carpel Tunnel Syndrome.

The apparatus disclosed hereinafter provides a construction for eliminating the need for a heavy duty, drive cable and an externally located motor to drive a massage head. The apparatus of the present disclosure provides for a more natural and more comfortable way to hold and control a massage head and provides for more power by employing self-contained "pancake" motor to drive the massage head. While such motors have been manufactured for years, the apparatus disclosed herein employs the pancake motor in a new and non-obvious way to drive a gyratory massage head/applicator and to obtain the unique massage action previously obtainable only with massage apparatuses having a heavy, duty drive cable and/or externally located motor.

SUMMARY OF THE DISCLOSURE

In accordance with the present disclosure, generally stated, a massage device is provided with an improved massage head which incorporates a more natural and more comfortable way to hold and control the massage head. In one embodiment, the device includes a pancake drive motor having a motor mounted counterweight associated with it, which compensates for eccentric forces generated by positioning an eccentric cam on the output shaft of the pancake drive motor.

Following are among the features of the invention:

the provision of a massage device which eliminates the need for a heavy, duty cable and an externally-located motor to drive a massage head;

the provision of a massage device having a self-contained internal motor providing more power;

the provision of a massage device having a more natural and more comfortable way to hold and control a massage head;

the provision of a control apparatus for controlling the operating speed of the massage head at the massage head itself;

the provision of providing a construction for a massage device which utilizes the weight of the motor for applying a portion of the necessary weight pressure on a massage recipient while isolating all electrical components of the apparatus from the massage recipient;

the provision of the massage device in which vibrations produced by the oscillatory motion are isolated from the user's hands; and the provision of the aforementioned massage device in which a counterweight reduces the vibrations transmitted to the user's hands by counterbalancing an off-center mounting of oscillating components.

The foregoing and other features of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

Figure 1:
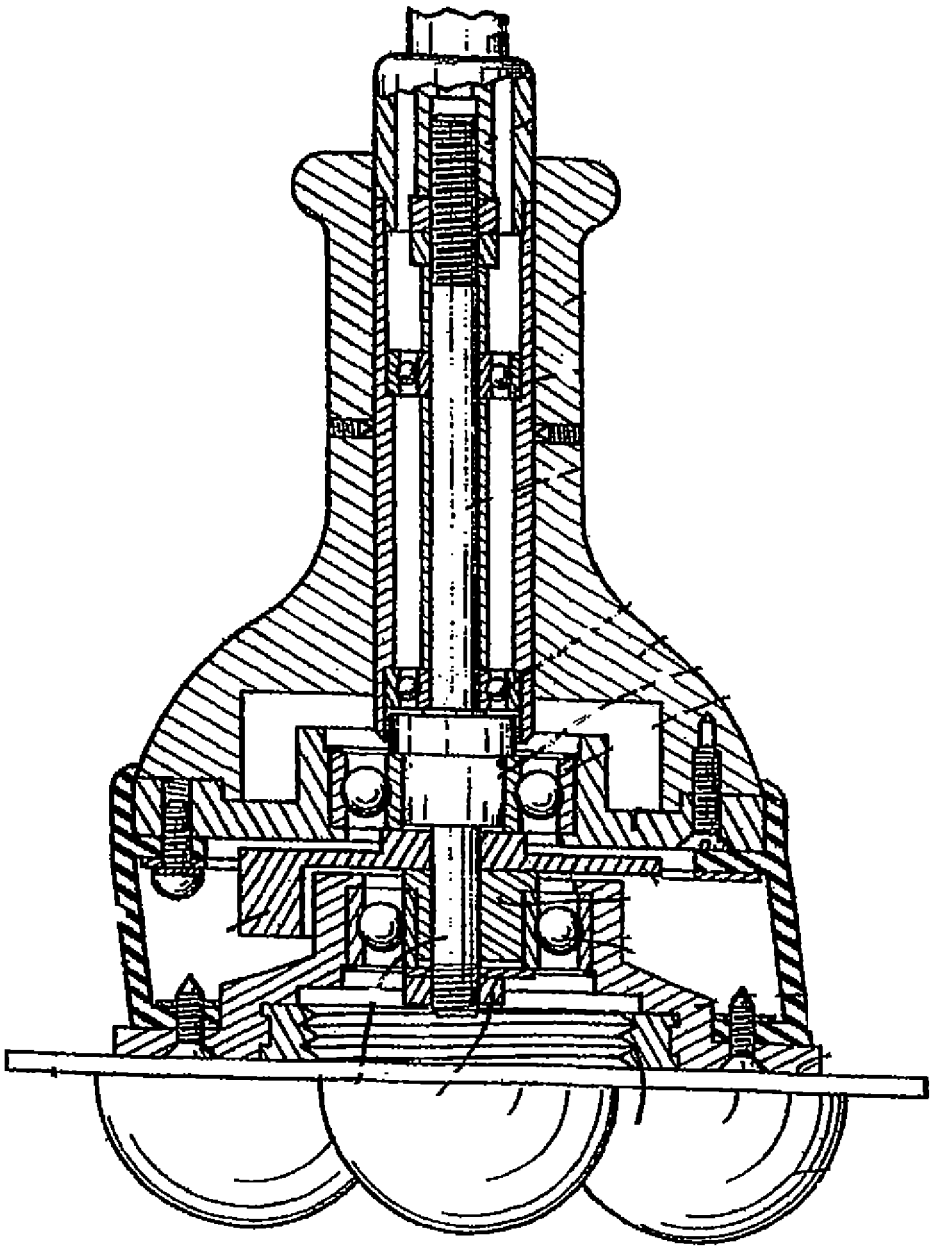
FIG. 1 PRIOR ART
FIG. 1 is a partial cross sectional view of a prior art massage head assembly illustrating drive shaft and massage components.
Figure 2:
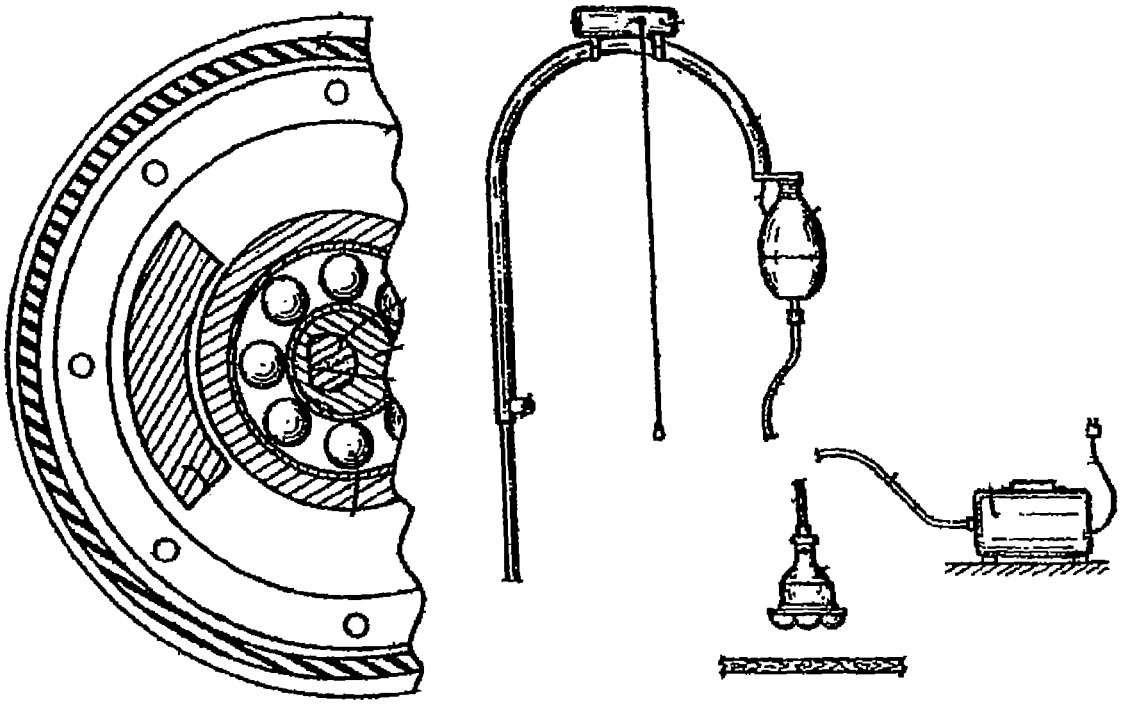
FIG. 2 PRIOR ART
FIG. 2 is a schematic view of components of the prior art massage head assembly of FIG. 1 illustrating an applicator, an external motor and a heavy duty drive cable associated with the applicator and the external motor.
Figure 3A:
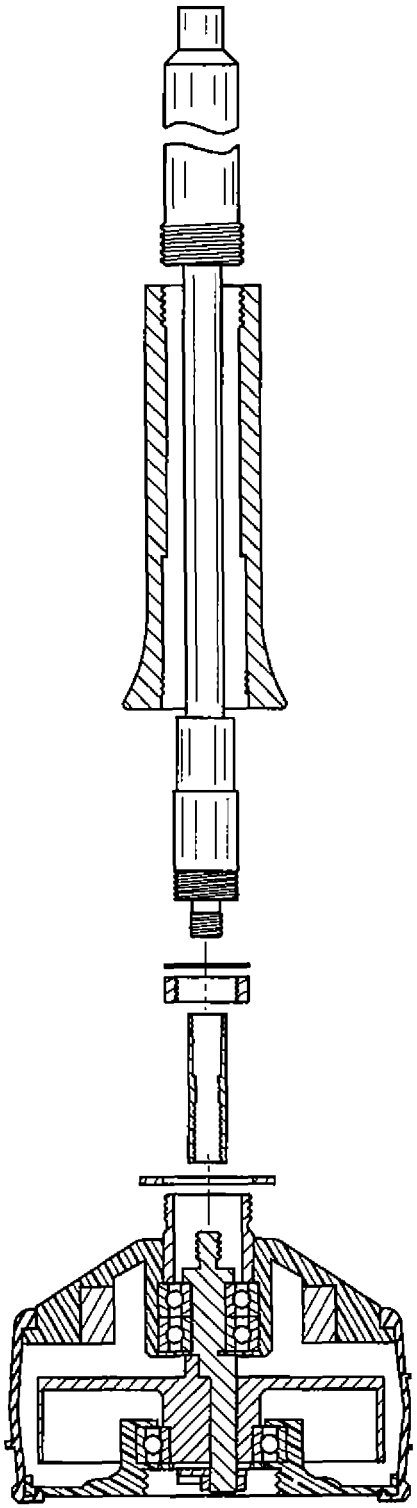
FIG. 3A PRIOR ART
FIGS. 3A and 3B are partial cross sectional views of another prior art massage head assembly illustrating drive shaft and massage components.
Figure 3B:
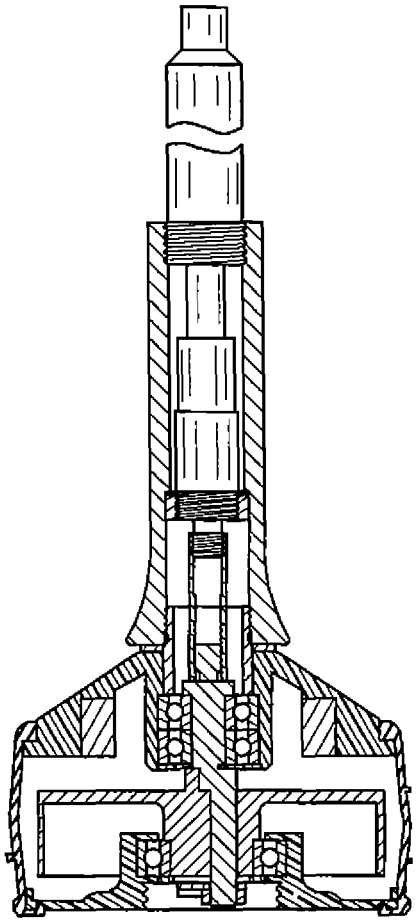
FIG. 3B PRIOR ART

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the invention.

The present disclosure relates to a massage apparatus, wherein the massage apparatus can be used in any appropriate therapeutic operation. However, for purposes for illustrations only, the massage apparatus will be described as incorporated into a commercial massage apparatus. While the apparatus is described with particular detail to commercial apparatus, those skilled in the art will recognize the wider applicability of the apparatus disclosed hereinafter.

Referring to the drawings, a massage apparatus, generally shown as "5" (FIGS. 4, 5 and 7), of the present disclosure can be made from a variety of materials, such as but not limited to, polypropylene, polyethylene, or other appropriate thermal plastic materials or metal. Further, the massage apparatus 5 can have a variety of shapes. The massage apparatus "5" can be of any size to accommodate users and/or recipients of any size.

Figure 4:
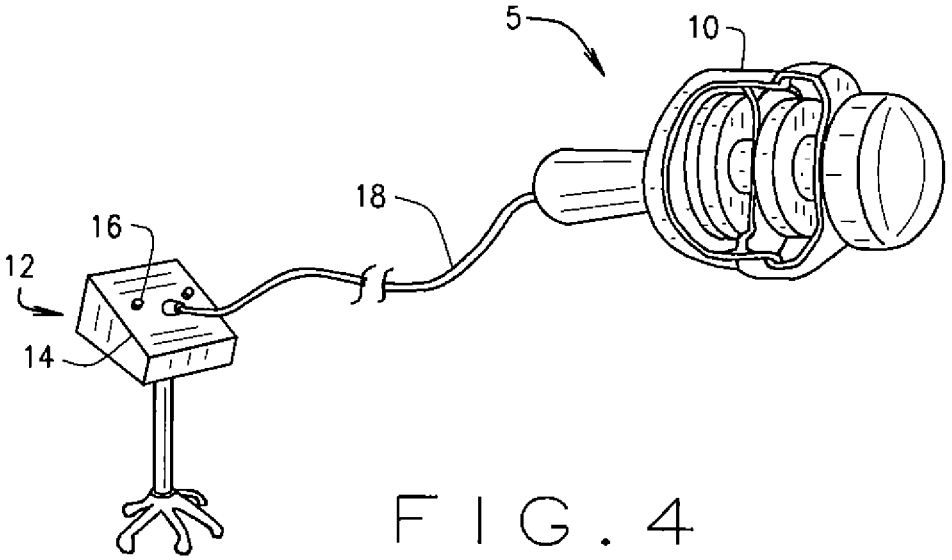
FIG. 4 illustrates a perspective, partial cross sectional view of one illustrative embodiment of controller and massage apparatus constructed in accordance with and embodying the present disclosure.

Referring to the drawings, the massage apparatus 5 comprises a housing 10 and a controller 12 (FIG. 4). The controller 12 optimally includes a control panel 14 having control devices 16 wherein the controller 12 operatively connects to the housing 10 by a light duty electrical power cord or cable 18.

Figure 5:
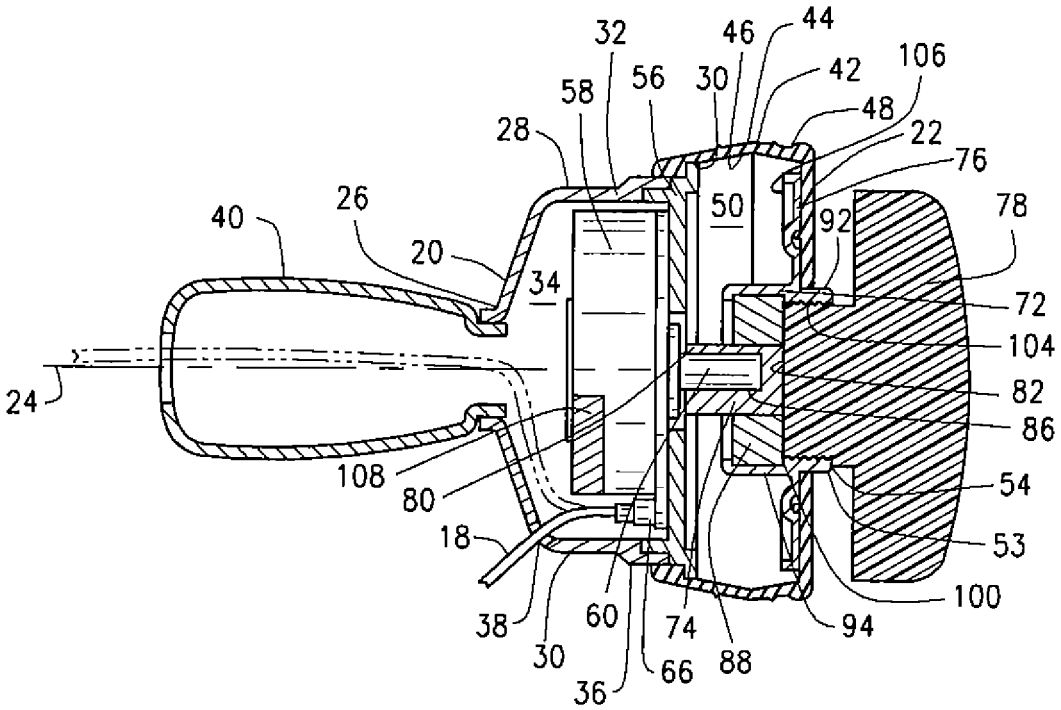
FIG. 5 is a cross sectional view of the massage apparatus of FIG. 4; and, illustrates internal structures that include a pancake motor positioned within a housing of the massage apparatus and that includes a handle and a motor counterweight.
Figure 6:
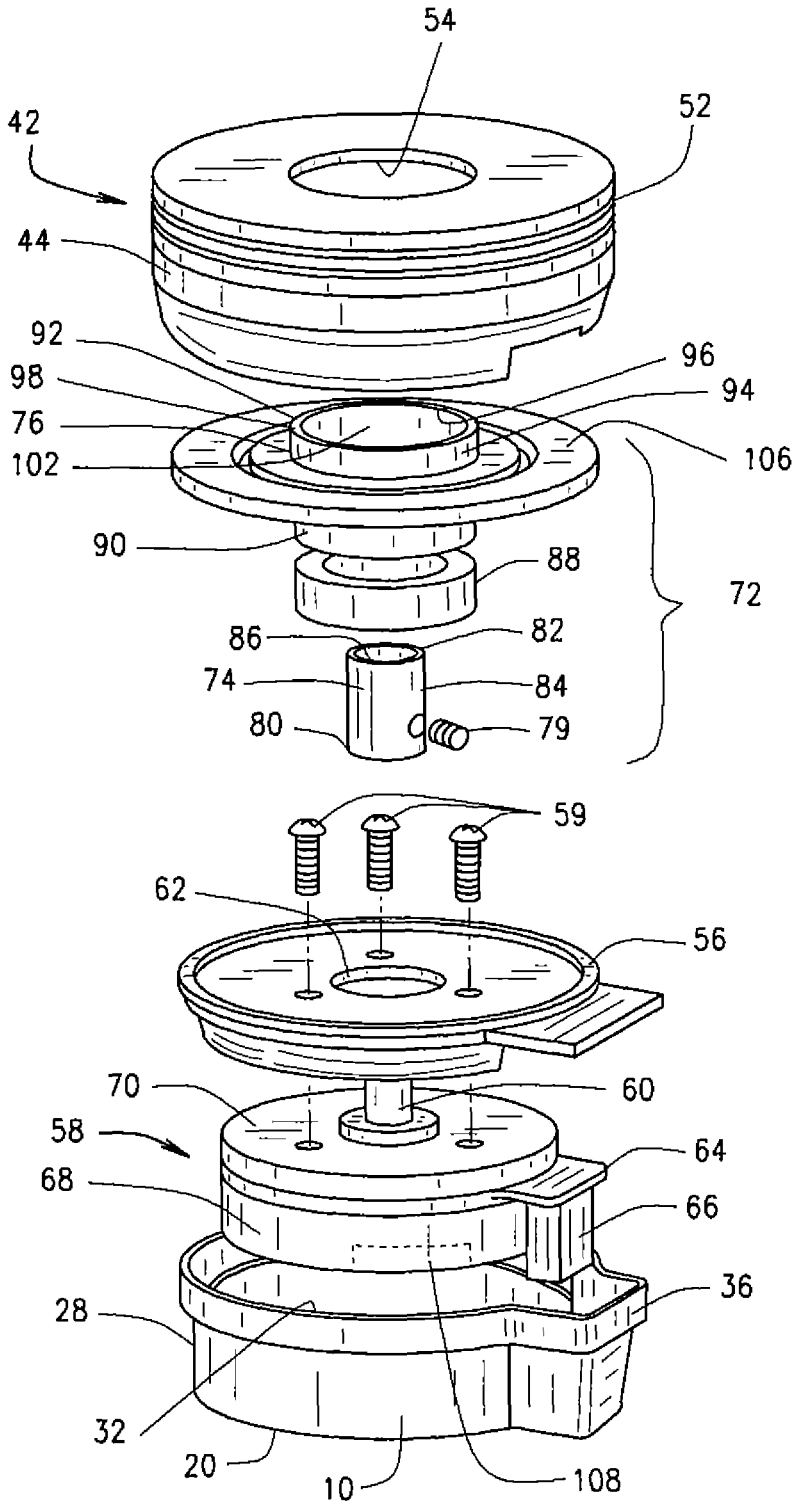
FIG. 6 is an exploded view of components of the massage apparatus shown in FIG. 5.
Figure 8:
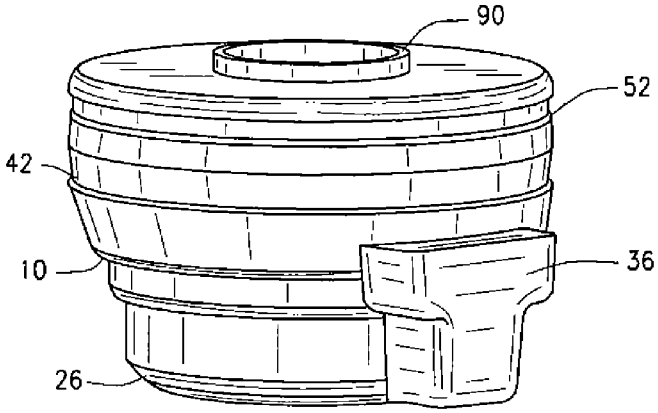
FIG. 8 is a side view of external structures of the massage apparatus of FIG. 5.

Turning to FIGS. 5, 6 and 8, the housing 10 comprises a first end 20, second end 22 and a longitudinal axis 24 extending through the housing 10 as measured from the first end 20 and to the second end 22. The first end 20 includes a hand portion 26 having a top 28, bottom 30 and side wall 32 connecting the top 28 and the bottom 30. The side wall 32 has a predetermined wall thickness. The top 28, bottom 30 and side wall 32 define an enclosed chamber 34. The bottom 30 also includes a receptacle casing 36 in communication with the enclosed chamber 34. The receptacle casing 36 has an aperture 38 defined there through. The aperture 38 is configured to sealably accept the power cable 18. Other arrangements for the power cable are compatible with the broader aspects of the invention. For example, the power cable 18 may be fed through a handle 40, if desired.

The handle 40 axially extends outward from the first end 20 of the housing 10 along the longitudinal axis 24. As will be appreciated by those skilled in the art, the handle 40 may be removably attached to the first end 20 of the housing 10, if desired. The hand portion 26 and handle 40 also can have a variety of shapes. Furthermore, the hand portion 26 and handle 40 can be made from variety of materials.

The second end 22 includes a cuff portion 42 having an outer surface 44, an inner surface 46 and a material thickness 48 connecting the outer surface 44 and the inner surface 46. The inner surface 46 defines another enclosed chamber 50 therein. The outer surface 44 includes grooves 52 (FIGS. 6 and 8) forming a living hinge. During operation, the living hinge flexes the material thickness 48 of the cuff portion 42. The cuff portion 42 further includes an end face 53 having an aperture 54 formed in it and positioned axially around the longitudinal axis 24 of the housing 10. The cuff portion 42 can have a variety of shapes. Furthermore, the cuff portion 42 can be made from a variety of materials.

As shown in FIG. 5, a bracket 56 connects the hand portion 26 and the cuff portion 42 within the housing 10. The bracket 56 is positioned between the hand portion 26 and the cuff portion 42. The bracket 56 comprises an electrical insulation material configured to electrically insulate and isolate the hand portion 26 and the cuff portion 42 from both the operator and from the recipient.

An electrical motor 58 mounts within the enclosed chamber 34 of the hand portion 26. Fasteners 59 connect the motor 58 to the bracket 56. The electric motor 58 includes a drive shaft 60 extending forward along a direction of the longitudinal axis 24 through bracket aperture 62 (FIG. 6) and into the enclosed chamber 50 of the cuff portion 42. The motor 58 includes a header 64 and receptacle 66 (FIG. 6) to operatively connect with the power cable 18. The header 64 and receptacle 66 fit within the receptacle casing 36 of the hand portion 26. In one embodiment, the header 64 comprises a type of header sold by Molex under part number 39-28-1083. Further, in an embodiment, the receptacle 66 comprises a type of receptacle sold by Molex under part number 39-01-2085.

The controller 12 regulates the operation of the massage apparatus of the present invention by controlling the flow of electric power to the motor 58. The motor 58 may include a voltage varying potentiometer and associated circuitry to regulate the electrical power distributed to the motor 58 from the controller 12. Those skilled in the art will recognize that a number of methods and structures are available for controlling power input to the motor 58. Electrical power is received by the motor 58 through the power cord 18, preferably a hospital grade three-line power cord with a standard three-prong adapter, entering the hand portion 26 through a cable opening. Surrounding the base of the conducting cable 18 as it enters opening 38 is a strain relief, adapted to prevent excessive bending or pulling on the cable 18.

Since the motor 58 is positioned within the hand portion 26, the construction eliminates the need for a heavy-duty drive cable cord and eliminates an externally located motor for driving the head assembly prevalent in prior art designs. Furthermore, the internal positioning of the motor 58 allows the mass weight of the motor 58 to apply weight pressure to the recipient during application of the massage apparatus 5 against the recipient. As indicated above, the bracket 56 isolates electrical components from the massage recipient and from the operator.

Figure 7A:
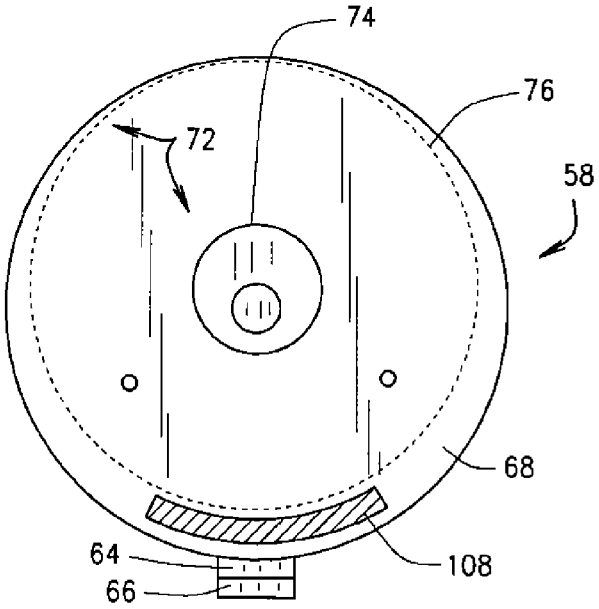
FIGS. 7A, 7B and 7C illustrate, respectively, a front view, a rear perspective view and a front perspective view of the pancake motor and counterweight of FIG. 5 and illustrate an offset cam connected to the pancake motor.
Figure 7B:
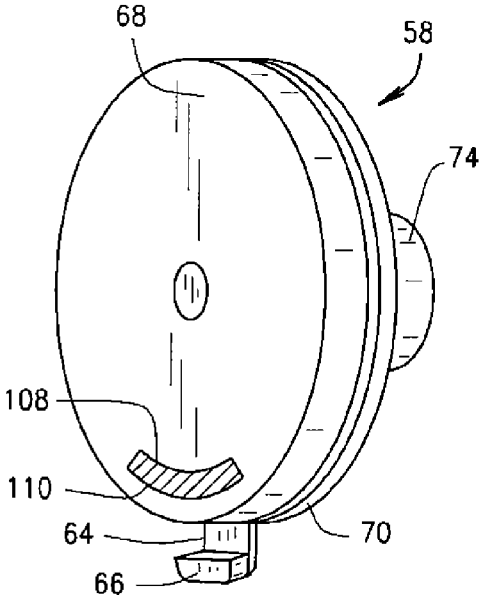
Figure 7C:
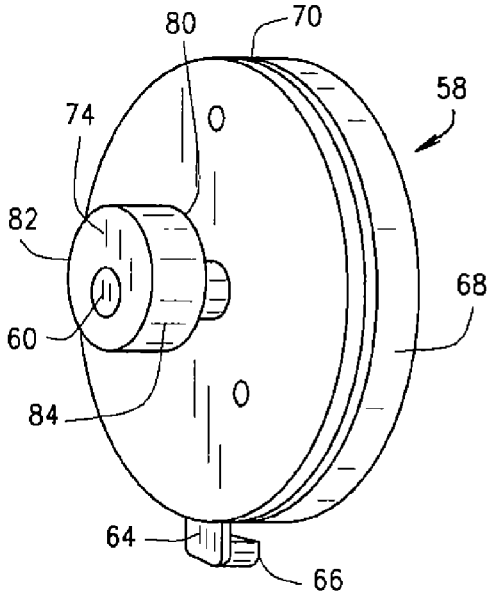

Turning to FIGS. 7A-7C, in one embodiment, the motor 58 comprises a brushless, pancake motor 58. The pancake motor 58 may comprise the type of motor sold under the Maxon brand "EC 90" series manufactured by Maxon Precision Motors, Inc. of Burlingame, Calif. The pancake motor 58 includes a base plate 68 and a rotor plate 70. The pancake motor 58 is electronically commutated to insure long motor life and trouble free operation since the pancake motor 58 does not have any mechanical brushes to wear out. Hall effect sensors preferably are positioned to be integral with the pancake motor 58 for providing a commutation signal to the motor. Other commutation methods are known in the art in addition to hall effect sensors, which methods may be employed in other embodiments of the massage apparatus 5 of the present invention In an embodiment, the pancake motor 58, for operator and recipient safety may comprise the following parameters: a 3.5 inch diameter, a 1.1 inch length (not including any shaft), 24 volt operation, 90 watts of output power, a maximum torque output of 55.6 oz-in., a maximum speed of 5,000 rpm, a weight of 1.4 lbs and an ambient temperature rating between −40° to 212° F. Other embodiments may include short length, large diameter motors as a means to reduce costs. The motor parameters are representative of an embodiment and are not intended to limit the scope of the disclosure. Any arrangement of motor parameters that is easily used for its intended purpose is acceptable. The configuration of the pancake motor 58 positioned within the housing 10 allows the housing 10 to have a length not exceeding ten inches. This is an important consideration in the operational use of the apparatus 5, in that an operator can easily manipulate the motor and any associated applicator in the administration of massage therapy to a recipient.

The operation of the pancake motor 58 may be regulated through the speed controller 12 wherein operating the speed controller 12 alters the voltage levels applied to the motor 58. The operational speed of the pancake motor 58 may be proportional to the potentiometer voltage levels; hence rotation of the speed controller 12 in an increasingly "on" direction increases the potentiometer voltage and correspondingly the rotational speed of the drive shaft 60 of the pancake motor 58. The rotation motion of the motor drive shaft 60 is in turn transmitted directly to the components of an oscillating assembly generally shown as 72 (FIG. 7A).

The oscillating assembly 72 (FIGS. 5 and 6) mounts within the enclosed chamber 50 of the cuff portion 42. The oscillating assembly 72 includes an eccentric cam 74, and a plate 76 which are adapted and arranged to attach an applicator 78 to the assembly, as latter described. The cam 74, shown in FIGS. 5, 6, 7A-7C, has a proximal end 80, distal end 82 and a body 84 disposed between the proximal end 80 and the distal end 82. A semi-cylindrical bore 86 extends from the proximal end 80 and into the body 84. The drive shaft 60 inserts within the bore 86 connecting the body 84 and the cam 74 via a fastener 79 such as a set screw. As such, the integral offset cam 74 protrudes from the drive shaft 60. The interlocking between the semi-cylindrical bore 86 and the drive shaft 60 prevents the cam 74 from rotating relative to the drive shaft 60. The cam 74 connects to the drive shaft 60 in an offset configuration to provide cam type movements. As shown in FIG. 5, a radial bearing 88 fits around the body 84 of the cam 74.

Referring to FIGS. 5 and 6, the plate includes a connector end 90, an applicator end 92 and a body 94 disposed between the connection end 90 and the applicator end 92. The body 94 has an outer wall 94, an inner wall 96 and side wall 98 connecting the outer wall 94 and the inner wall 96. The inner wall 96 includes a shoulder 100 positioned about midway along the body 94. An axial cylindrical bore 102 extends through the body 94, the bore 102 receiving the outer race of the bearing 88 by a press fit. The shoulder 100 contacts the outer race of the bearing 88 and acts as a position stop when the connection end 90 fits around the bearing 88. The body 94 of the plate extends through the aperture 54 of the cuff portion 42 to extend the applicator end 92 beyond the aperture 54 of the cuff portion 42. The applicator end 92 includes a connector 104 such as, but not limited to, a threaded end. Any locking mechanism that can be employed to secure the applicator 78 is intended to be within the scope of the invention. Merely by way of example, various connection techniques are described in U.S. Pat. No. 7,354,408, the specification of which is incorporated herein by reference. The plate 76 further includes a flange 106 axially extending outward from the outer wall 94. In this position, the flange 106 is located within the enclosed chamber 50 of the cuff portion 42.

The inner race of bearing 88 is press-fitted around the outer circumference of the offset cam 74, such that the plate 76 is fitted directly adjacent the forward surface of the cam 74. Thus, the oscillating plate 76 mounts about the offset cam 74 axially outward thereof. The forward oscillating plate 76, being mounted about the bearing 88 and the offset cam 74 is therefore eccentrically mounted such that rotation of the drive shaft 60 and the cam 74 causes the forward oscillating plate 76 to oscillate in an orbital motion.

The applicator 78 removably attaches to the oscillating plate 76. The applicator 78 may removably connect to the oscillating plate 76 via the connector 104 of the applicator end 92. As described above, other connection techniques will be apparent to those skilled in the art. The oscillating assembly 72 translates rotary motion of the drive shaft 60 into orbital oscillations via the offset cam 74. Thus, the oscillating plate 76 oscillates in an orbital motion upon rotation of the drive shaft 60. The applicator 78 applies repetitive massage force to the recipient. Since the applicator 78 removably connects to the oscillating plate 76, a variety of applicators 78 may be used to apply the repetitive massage force to the recipient. Any type of applicator 78 that is easily used for its intended purpose is acceptable.

As shown in FIG. 5, a counterweight 108 may be mounted within the housing 10 in a variety of configurations. In an embodiment, the counterweight 108 operatively connects to the pancake motor 58. Turning to FIGS. 7A-7C, optimally, the counterweight 108 operatively connects to the base plate 68 of the pancake motor 58. In one embodiment, an arcuate shaped counterweight 108 is integrally secured within a depression 110 in the forward face of base plate 68, spanning an arc of approximately 120 degrees and centered perpendicular to the flattened face as best seen in FIGS. 7A and 7B. The counterweight 108 is preferably composed of a dense material and produces a flywheel effect minimizing the vibrations transferred along the drive shaft 60. The counterweight 108 preferably does not extend beyond the outer circumference of the base plate 68.

The counterweight 108 decreases vibrations in the hand portion 26 by compensating for forces generated by the oscillating plate 76 as the oscillating plate 76 oscillates the applicator 78 in the orbital motion. Accordingly, the compensating effects of the counterweight 108 decrease the fatigue of the operator.

Figure 9:
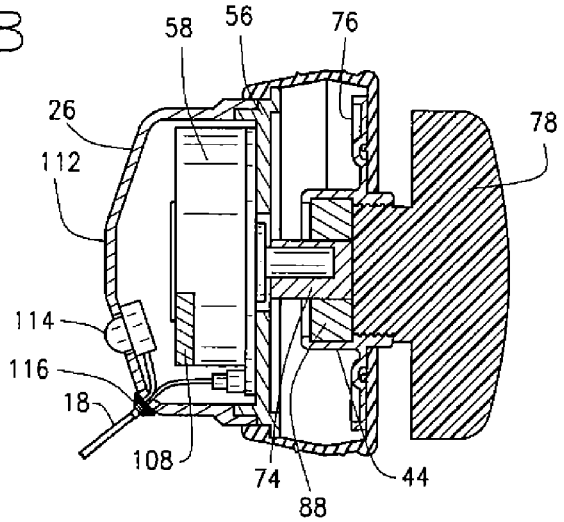
FIG. 9 is a cross sectional view of another illustrative embodiment of a massage apparatus constructed in accordance with and embodying the present disclosure; and, illustrating a counterweight operatively connected to the pancake motor.
Figure 10:
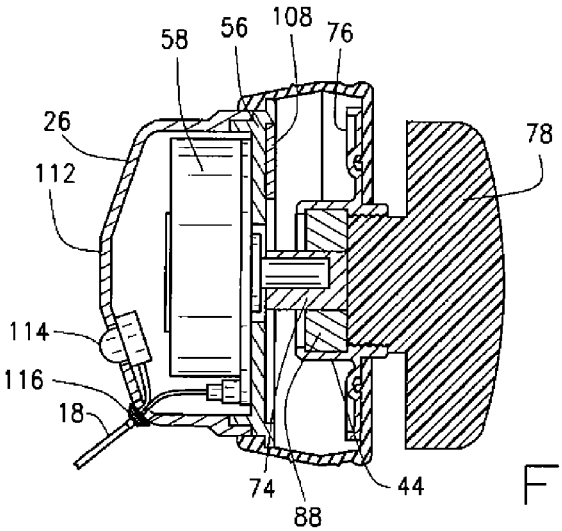
FIG. 10 is a cross sectional view of another illustrative embodiment of a massage apparatus constructed in accordance with and embodying the present disclosure; and, illustrating a counterweight operatively connected to an oscillating assembly.

Turning to FIGS. 9 and 10, other embodiments of the present disclosure are shown. In these embodiments, the hand portion 26 includes a rear cover 112 wherein speed controller 114 mounts on the rear cover 112. The speed controller 114 controls the operating speed of the motor 58 at the hand portion 26 itself. The speed controller 114 includes a speed controlled dial and an on/off switch. As shown, the power/conductive cable 18 electrically connects to the speed controller 114 and the pancake motor 58 for controlling operation of the motor 58. Surrounding the base of the conducting cable 18 as it enters the cable opening is a strain relief 116, adapted to prevent excessive bending or pulling on the cable 18. In these embodiments, the pancake motor 58 mounts axially within the housing 10 and the oscillating assembly 72 mounts within the cuff portion 42 as previously discussed. Further, the applicator 78 removably connects to the oscillating plate 76. In the embodiment of FIG. 9, the counterweight 108 operatively connects to the pancake motor 58. In the embodiment of FIG. 10, the counterweight 108 maybe operatively mount within the cuff portion 42. Optimally, the counterweight 108 operatively connects to the oscillating assembly 72.

Figure 11:
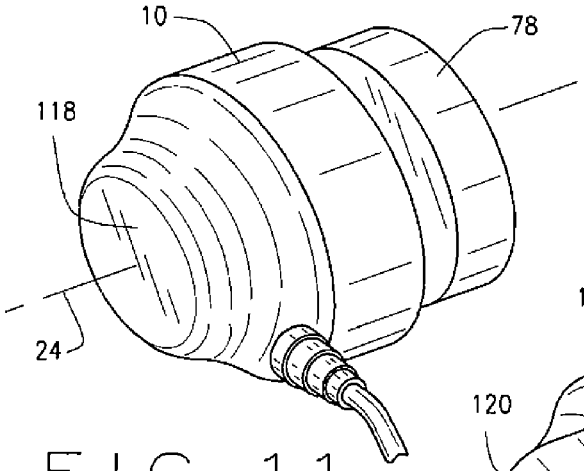
FIG. 11 is a perspective view of one embodiment of a handling member of the massage apparatus of the present disclosure.
Figure 12:
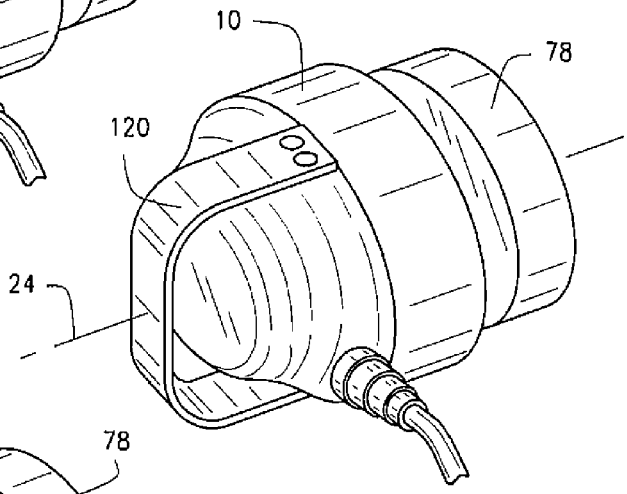
FIG. 12 is a perspective view of another embodiment of a handling member of the massage apparatus of the present disclosure.
Figure 13:
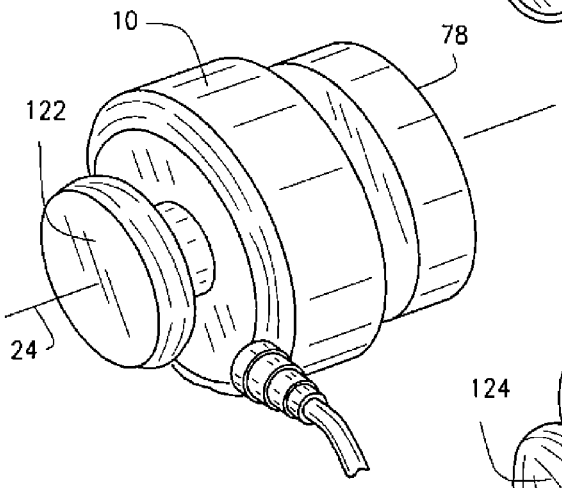
FIG. 13 is a perspective view of another embodiment of a handling member of the massage apparatus of the present disclosure.
Figure 14:
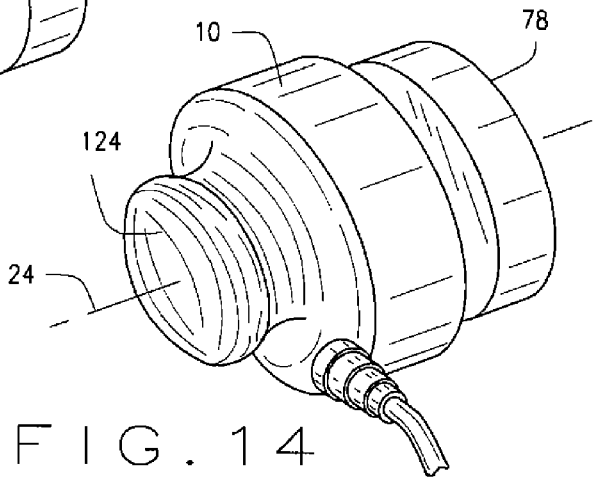
FIG. 14 is a perspective view of another embodiment of a handling member of the massage apparatus of the present disclosure.
Figure 15:
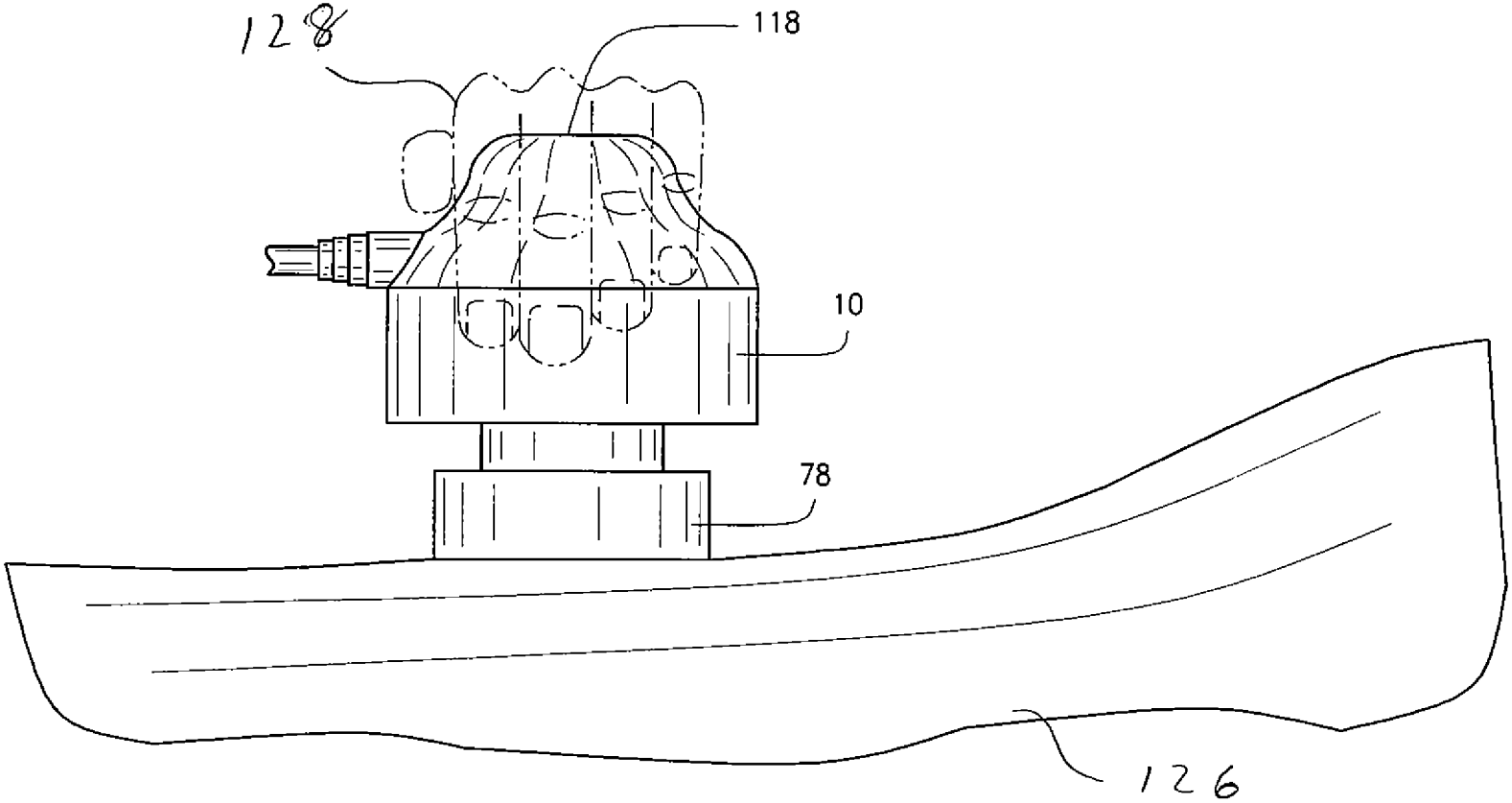
FIG. 15 is a side elevational view of an operator handling the massage apparatus against a recipient.

FIGS. 11-14 illustrate different embodiments of handling members 118, 120, 122 and 124 of the housing 10. As shown, the handling members 118, 120, 122 and 124 are positioned co-axially along the longitudinal axis 24 and opposite the cuff portion 42. These handling members 118, 120, 122 and 124 provide for a more natural and more comfortable way to hold and control the massage apparatus 5. In particular, the handling members 118, 120, 122 and 124 are sized and shaped to provide easier too use hand and arm positions for the operator with a flat, parallel-to-body, palm held head as opposed to handle held heads prevalent in prior art designs. As shown in FIG. 11 the handling member comprises a rounded surface. In FIG. 12, the handling member comprises a rounded surface and a strap. In FIG. 13, the handling member comprises a suspended knob. In FIG. 14, the handling member comprises an integral knob. FIG. 15 illustrates an operator handling member 188 in a substantially flat, parallel-to-body, palm held position against the recipient's body 126.

The configurations of the housing 10 and handling members 118, 120, 122 and 124 support the operator's hand 128 during use as opposed to the operator constantly applying force against the prior art handle held heads. The operator has the ability to comfortably rest the applicator 78 on the recipient's body 126 as opposed to holding the apparatus 5 in place against the body 126. Additionally, the configuration of the housing 10 and handling members 118, 120, 122 and 124 minimize exposure to vibration energy produced by the applicator 78 to operator's hand.

In operation, the present disclosure relates to a method of applying a therapeutic application of repetitive forces from an improved, self-contained and hand-held massage apparatus to a recipient. More particularly, the present invention is a portable hand-held massage unit which may be used to loosen and to mobilize bronchial secretions in the recipient's body, or used to apply force to various parts of the body such as the legs, to improve the circulation of blood, mobilize edema fluids, or to relax muscles, while simultaneously reducing the level of vibration felt by the user holding the unit.

As the improved apparatus 5 is moved inward towards and across the body surface, the massage apparatus 5 thereby imparts to the recipient a force to the body surface to which the massage apparatus 5 is applied. This movement imparts a percussive force against the recipient's body as well as a directional stroking force across the surface of the body. The directional stroke depends upon the direction of the orbital movement of the massage apparatus 5, and in the direction that the apparatus 5 moves across the body.

The percussive force of the massage apparatus 5 acts to loosen bronchial secretions, for example, while the directional force has the effect of mobilizing the secretions in the direction of the directional stroke. The massage apparatus 5 can thus be placed against the torso in selected positions to mobilize bronchial secretions away from an area in a chosen direction.

The improved massage apparatus 5 may also be used to improve blood circulation in parts of the body such as the legs. In this case, the massage apparatus 5 is placed along the leg at a location where improved circulation is desired such that the massage adapter will have a directional stroke in the direction in which increased blood flow is desired. While the offset cam 74 oscillates, the forward oscillating plate 76 and attached massage applicator 78 impart a force to the blood vessels so that the blood is forced in the preselected direction through the blood vessels. Thus, the massage apparatus 5 can be placed to propel blood from the legs towards the heart, or toward another body area. These particular applications are merely illustrative, and the massage techniques available with the embodiments of the disclosure are applicable to a wide variety of applications.

In one method of operation, the human user controls the applicator portion of the apparatus 5 through a hand portion 26 of the massage apparatus 5 and activates the controller 12. The controller 12 controls the pancake motor 58 positioned within the hand portion 26, wherein the pancake motor 58 connects with the oscillator assembly 72. The method also comprises controlling the speed of the pancake motor 58 wherein the pancake motor 58 drives the oscillating assembly 72 to apply the repetitive force to the recipient. Additionally, the method of the present disclosure comprises isolating electrical components from the massage recipient. During operation, the counterweight 108 compensates/diffuses vibrations caused by the oscillating assembly 72.

In particular during operation, the rotation of the drive shaft 60 rotates the offset cam 74 secured to the drive shaft 60. The offset cam 74 traverses an orbital path during the rotation of the drive shaft 60. Correspondingly, the forward oscillating plate 76 fitted on the bearing 88 around the offset cam 74 oscillates in an orbital motion. The massage applicator 78 that is removably connected to the oscillating plate 44 will oscillate in the same orbital motion as the oscillating plate 44.

During the operation of the portable massage apparatus 5, housing 10 acts to prevent the hands or other body parts from being harmed by any of the moving parts of the massage unit. Additionally, the counterweight 108 operatively connected to the pancake motor 58 or the oscillating assembly 72 acts to isolate the operator's hands from the vibratory motions produced by the offset cam 74, which substantially reduces the vibrations transmitted through the housing 10 correspondingly reduces the risk of repetitive motion injury to the operator.

The various massage applicators 78 which may be removably connected to the oscillating plate 76 may include a variety of shapes and sizes, each specifically designed to provide oscillating and percussion forces at varying intensities to various parts of the body. Massage applicators 78 may be quickly and easily interchanged by simply unscrewing or otherwise detaching the current massage applicator 78 from the oscillating plate 76 or adapter ring and screwing or otherwise attaching another massage applicator 78 having the desired characteristics to the device.

Under the massage apparatus of the present disclosure, the positioning of the pancake motor 58 within the housing 10 eliminates the need for a heavy-duty drive cable and an externally located motor to drive the applicator 78 while allowing the pancake motor 58 to provide the operational characteristics of required by health care professionals. Furthermore, the internal positioning of the pancake motor 58 utilizes the weight 108 of the pancake motor 58 for application of proper and necessary weight pressure on the recipient. Additionally, the configuration of the handling members 118, 120, 122 and 124 provides for a more natural and more comfortable way to hold and control the massage apparatus 5.

The present massage apparatus 5 provides easier to use hand and arm positions with a flat, parallel-to-body, palm held head as opposed to handle held heads. Additionally, the massage apparatus 5 provides the operator the ability to comfortably rest applicator 78 on the recipient's body as opposed to holding the apparatus in place against the body. Furthermore, the positioning of controller 114 on the hand portion 26 allows for controlling the operating speed of the pancake motor 58 at the hand portion 26 itself. The apparatus of the present disclosure also provides a means for isolating the electrical components from contact with the operator and/or recipient.

The present disclosure can be embodied in the form of computer-implemented processes and apparatuses for practicing those processes. The present disclosure can also be embodied in the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the disclosure.

Numerous variations within the scope of the appended claims will be apparent to those skilled in art. As various changes could be made in the above constructions without departing from the scope of the disclosure, it is intended that all matter contained in the above description or shown in the accompanying drawings shall be interpreted as illustrative and not in a limiting sense.

The invention claimed is:

1. A portable massage apparatus for use by an operator in the therapeutic application of repetitive vibratory force to a recipient, the massage apparatus comprising:

a housing having a longitudinal axis, the housing defining a hand portion extending radially outwardly from the longitudinal axis sized to fit and accept simultaneously both the palm and fingers for the hand of a user, and a cuff portion, and an electrically nonconductive bracket connecting and separating the hand portion and cuff portion, the bracket being configured to insulate and isolate the hand portion and the cuff portion from the operator and the recipient respectively, the hand portion being sized and shaped for suitable use by a human user such that the hands of the user always are generally perpendicular to the longitudinal axis and axially outboard of the bracket in application use, the axis always passes through the hand or hands of the user during use, the hand portion further having a top for the accepting the user's hands, a bottom, and a side defining first enclosed chamber, the cuff portion having an outer surface and an inner surface defining a second chamber;

a motor mounted within the first enclosed chamber, the motor having a rotatable drive shaft extending along the direction of the longitudinal axis from the first enclosed chamber into the second chamber;

an oscillating assembly mounted within the second chamber, the oscillating assembly including an offset cam operatively connected to the drive shaft, and a plate mounted about the offset cam axially outwardly thereof, the plate oscillating in an orbital motion upon rotation of the drive shaft thereby translating rotary motion of the drive shaft into orbital oscillations of the plate; and a counterweight mounted within the housing wherein the counterweight decreases vibration in the hand portion by compensating forces generated by the plate as the plate oscillates in the orbital motion.

2. The portable massage apparatus of claim 1 further comprising an applicator connected to the plate.

3. The portable massage apparatus of claim 2 wherein the mass of the motor applies a weight pressure to a recipient along the longitudinal axis in applicational use.

4. The portable massage apparatus of claim 3 further comprising a speed controller mounted on the hand portion of the housing and operatively connected to the motor.

5. The portable massage apparatus of claim 4 wherein the counterweight is operatively connected to the motor.

6. The portable massage apparatus of claim 4 wherein the counterweight is operatively connected to the oscillating assembly.

7. The portable massage apparatus of claim 4 wherein the motor comprises a brushless pancake motor having a base plate and a rotor plate.

8. The portable massage apparatus of claim 7 wherein the counterweight is mounted to the pancake motor at a position on the base plate.

9. The portable massage apparatus of claim 1 wherein the hand portion further comprises a handling member co-axially positioned opposite the cuff portion and at an end of the housing.

10. The portable massage apparatus of claim 9 wherein the handling member is sized and shaped for palm held handling by the operator.

11. The portable massage apparatus of claim 10 wherein the handling member comprises at least one a rounded surface, a handle, a knob and a strap.

12. A portable massage apparatus for use by an operator in the therapeutic application of repetitive force to a recipient, the massage apparatus comprising:

a housing having a hand portion, a cuff portion and an electrically nonconductive bracket connecting and separating the hand portion and cuff portion from one another along a longitudinal axis of the housing, the hand portion being sized and shaped for suitable use by a human in a manner so that the longitudinal axis passes through the hand or hands of the user, the hands of the user generally being perpendicular to the longitudinal axis of the massage apparatus and generally parallel to and outboard of the nonconductive bracket, the housing further and having a top, a bottom, and a side defining a first enclosed chamber, the cuff portion having an outer surface and an inner surface defining a second enclosed chamber the first and second chambers being electrically insulated by the bracket positioned between the respective first and second chambers;

a motor mounted within the first enclosed chamber of the hand portion, the motor having a rotatable drive shaft extending along the direction of the longitudinal axis from the first enclosed chamber of the hand portion and into the second enclosed chamber of the cuff portion;

an oscillating assembly mounted within the second enclosed chamber of the cuff portion, the oscillating assembly including an offset cam connected to the drive shaft, including a plate mounted about the offset cam axially outwardly thereof, the plate oscillating in an orbital motion upon rotation of the drive shaft thereby translating rotary motion of the drive shaft into orbital oscillations of the plate;

an applicator connected to the plate; and a handling member co-axially positioned opposite the cuff portion and at an end of the housing, the handling member being sized and shaped for palm held handling by the operator such that the longitudinal axis passes through the hand or hands being used by the user and the hand or hands are positioned outboard and parallel to the oscillating assembly such that the handling member decreases vibration in the hand portion generated by the plate as the plate oscillates in the orbital motion.

13. The portable massage apparatus of claim 12 further comprising a speed controller mounted on the hand portion and in operative connection with the motor.

14. The portable massage apparatus of claim 12 wherein the motor is a pancake motor having an output up to and including 90 watts of power.

15. The portable massage apparatus of claim 12 wherein the motor outputs torque up to and including 55.6 oz/in.

16. The portable massage apparatus of claim 12 wherein mass of the motor applies a weight pressure to the recipient.

17. A method of applying a therapeutic application of repetitive forces from a hand held massage apparatus having a longitudinal axis by an operator to a recipient, the method comprising:

palming a handling member of a housing of the massage apparatus in a manner generally perpendicular to the longitudinal axis so that the longitudinal axis passes through the hands of the user and the hands of the user are not parallel to or aligned with the longitudinal axis in application use, the housing having a hand portion and a cuff portion;

activating a controller that is operatively connected to a motor that is positioned within the hand portion, the motor being electrically isolated from the operator and the massage recipient by a nonconductive bracket positioned between the hand portion and the cuff portion such that the hands or the user are parallel to the and out board of the nonconductive bracket and;

controlling an operating speed of the motor;

translating rotary motion of a drive shaft of the motor by a cam connected to the drive shaft to oscillating motion;

transferring the oscillating motion to an applicator; and moving an applicator against the recipient in a substantially flat, parallel motion against the recipient wherein the moving applicator generates the repetitive force when contacting the recipient.

18. The method of claim 17 further comprising decreasing vibrations caused by the repetitive force of the applicator and applied to the hand portion by applying a counterweight to the motor.

19. The method of claim 17 further comprising decreasing vibrations caused by the repetitive force and applied to the hand portion by applying a counterweight to the cam.

* * * * *